United States Patent [19]

Dussourd et al.

[11] Patent Number: 5,020,970

[45] Date of Patent: Jun. 4, 1991

[54] FLUID-HANDLING, BLADED ROTOR

[75] Inventors: Jules L. Dussourd, Princeton, N.J.; Pawan J. Singh, Quakertown, Pa.; J. C. Miller, Rockford, Ill.

[73] Assignee: Dresser-Rand Company, Corning, N.Y.

[21] Appl. No.: 379,315

[22] Filed: Jul. 13, 1989

[51] Int. Cl.[5] ..... F01D 5/14

[52] U.S. Cl. ..... 415/115; 415/914

[58] Field of Search ..... 415/115, 116, 914, 169.1

[56] References Cited

U.S. PATENT DOCUMENTS

| | | | |
|---|---|---|---|
| 3,846,038 | 11/1974 | Carriere et al. | 415/914 X |
| 4,146,352 | 3/1979 | Yasugahira et al. | 415/914 X |
| 4,335,995 | 6/1982 | Riollet et al. | 415/914 X |

*Primary Examiner*—William E. Wayner

*Attorney, Agent, or Firm*—Bernard J. Murphy

[57] ABSTRACT

The rotor has a body with recesses formed therein in which airfoil-type blades are secured. The blades have platforms which abut one another to define an annular wall which circumscribes the rotor body. One edge of each of the platforms, which abuts an adjacent platform, has a rectilinear cut-out formed therein. The resulting void constitutes a slot which extracts fluid therethrough, and each void has an evacuating duct in communication therewith for venting the extracted fluid. The voids and ducts bleed off a minimal volume of the fluid handled by the rotor, principally the volume which comprises the secondary flows. These are the secondary flows which, otherwise, would result in the formation of eddies and vortices which are susceptible of eroding the roots of the blades.

10 Claims, 3 Drawing Sheets

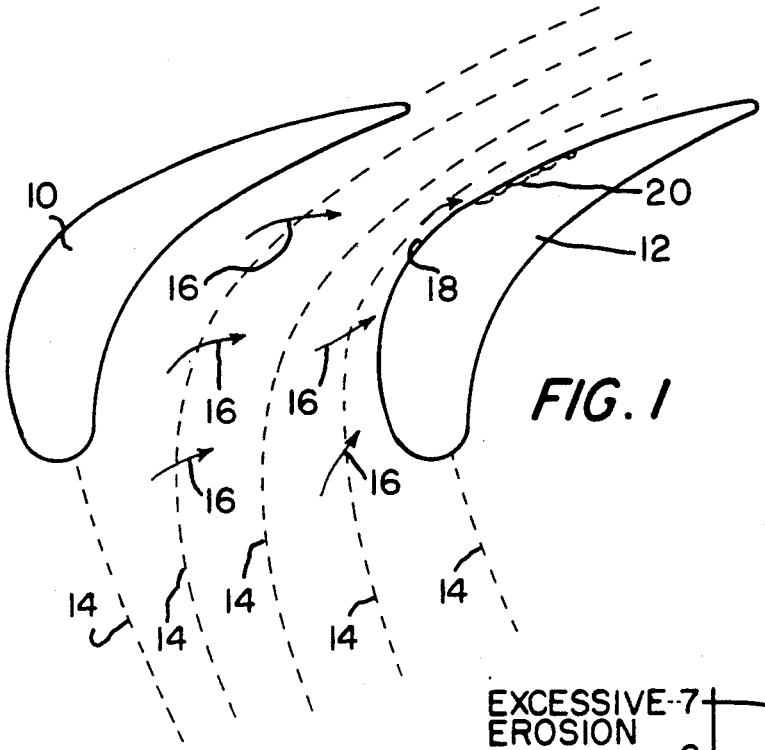
FIG. 1
FIG. 5
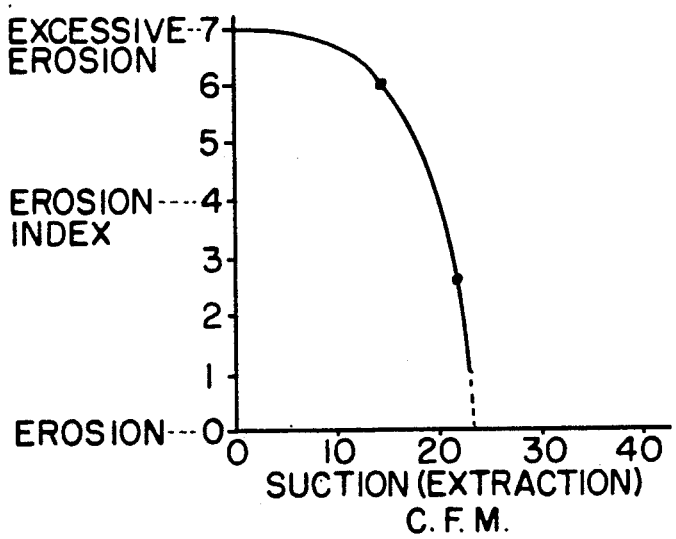
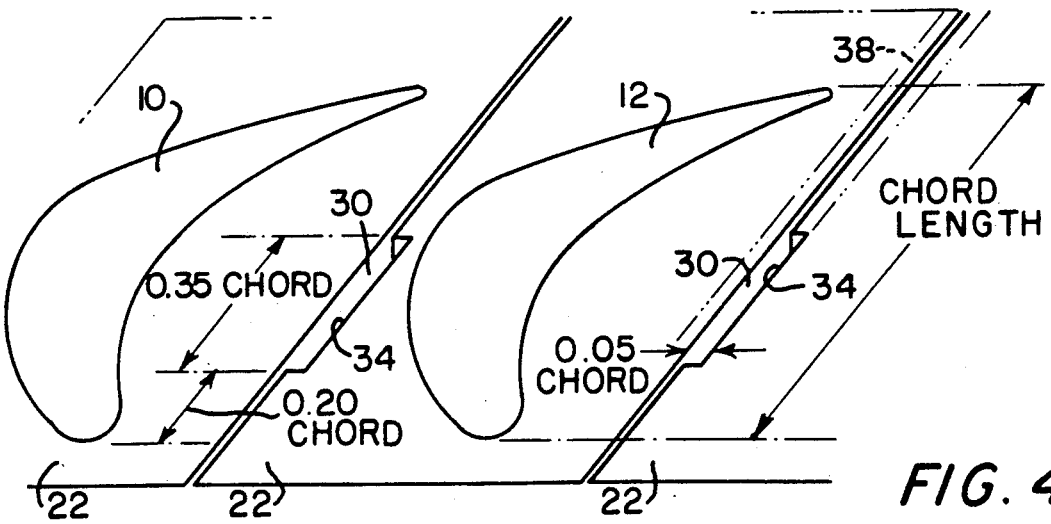
FIG. 4

FLUID-HANDLING, BLADED ROTOR

This invention pertains to bladed rotors, such as are used in turbines, gas expanders, pumps, and the like, and in particular to such a bladed rotor which has means for controlling and minimizing secondary erosion thereof.

Bladed rotors, used in high-speed turbo machines which handle gases, or liquids, ladened with solid particles, commonly suffer from erosion problems. Such machines, i.e., dirty gas expanders, and pumps handling contaminated fluids or slurry transporting solids, are typical of those which encounter the problem.

The aforesaid erosion problems, depending upon the size of particles suspended in the fluid being handled, as well as upon other properties of the fluids or particulate, arise from either or both primary erosion and secondary erosion. Primary erosion is induced by relatively large particles (viz., solid particulate in gases with a diameter of the order of ten microns). In general, these particles cannot follow the streamlines of the gas and, consequently, impinge against concave surfaces of the blades, as well as tending to migrate towards the outside diameter of the machine.

Secondary erosion is introduced by very fine particles (typically in the order of one micron in diameter), and produces a rather different type of damage to the blades. The particles are so fine that they become trapped in the complex secondary flows of the passages, and interact with the vortices. Typically, the secondary flows sweep these particles inward and along the walls toward the convex surfaces of the blades. Very severe damage can be produced by secondary erosion, because it tends to attack the roots of the blades. In dirty gas expanders, forms of digging, wormholing and channeling have been seen as a result of secondary erosion.

It is an object of this invention, then, to set forth a novel, fluid-handling, bladed rotor which has means for controlling and minimizing secondary erosion thereof.

Particularly, it is an object of this invention to disclose a fluid-handling, bladed rotor, comprising a rotor body; said body having a plurality of juxtaposed recesses formed therein; an annular wall circumscribing said body; elongate blades; each of said blades having (a) a first, radially-extending end projecting outwardly from said wall, and (b) an opposite, attachment end set in one of said recesses; wherein adjacent ones of said blades define fluid flow passages therebetween which accommodate a given fluid flow capacity therewithin; and means in said wall for extracting fluid from said passages; wherein said means comprises means for extracting between approximately one-third of one percent to approximately one and two/thirds percent of said capacity of said passages.

Further objects of this invention, as well as the novel features thereof, will become more apparent by reference to the following description, taken in conjunction with the accompanying figures, in which:

FIG. 1 shows a pair of adjacent blades, in plan view, as used in a turbine, with both primary and secondary flow patterns, and a location on one of the blades where the more severe secondary erosion is encountered;

FIG. 4 is a line drawing illustrating further details of the invention, namely optimum dimensional relationships; and FIG. 5 is a graph or plot of results of wind tunnel tests of the invention.

Figure 2:
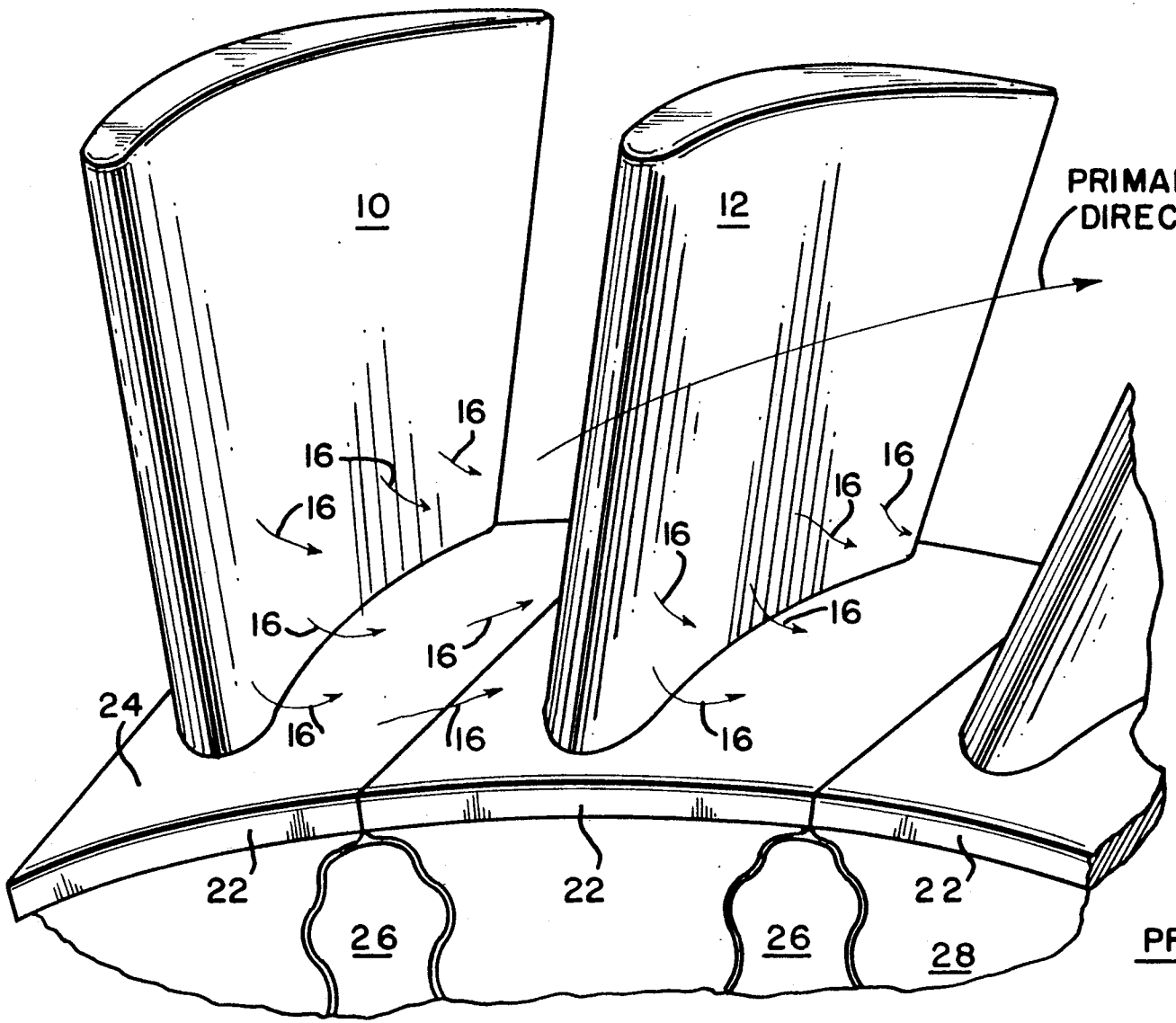
FIG. 2 PRIOR ART
FIG. 2 is a perspective illustration of a portion of a bladed rotor depicting the primary flow direction and the secondary flows near the bases of the blades.

As shown in FIG. 1, a pair of air-foil type blades 10 and 12, as used in a dirty gas expander, for instance, receive the primary flow of gas which conforms to the streamlines 14 shown in broken lines. The secondary flows of gas are represented by the full-line arrows 16. The convex surface 18 of blade 12 suffers the secondary erosion 20 where indicated.

FIG. 2 illustrates the attack of the secondary flows 16 near the bases of the blades 10 and 12, where the platforms 22 of the blades abut to form a wall 24 which circumscribes the body 26 of the rotor 28.

Figure 3:
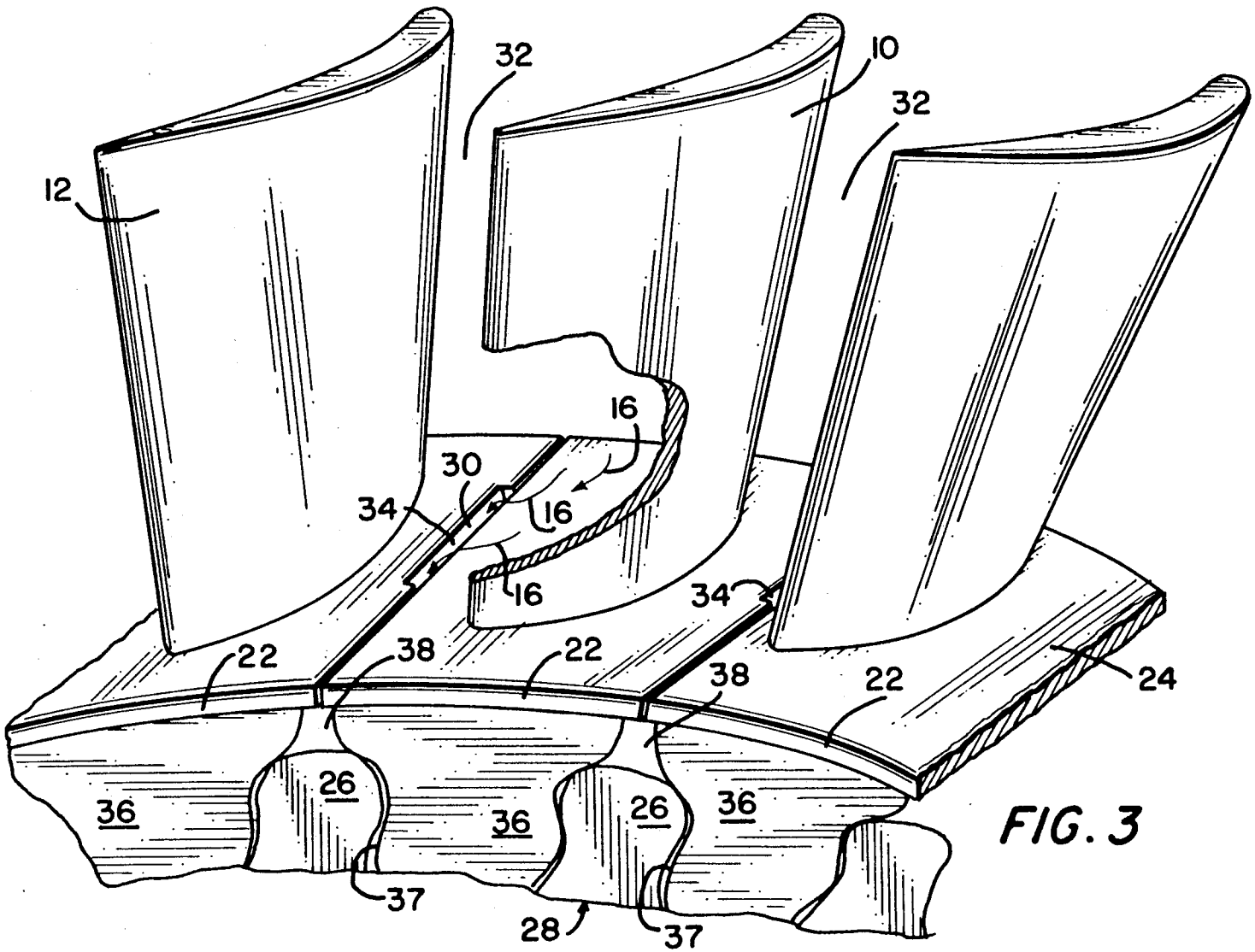
FIG. 3 is an illustration, similar to that of FIG. 2, albeit a downstream view of a bladed rotor portion, depicting an embodiment of the invention.

According to an embodiment of the invention, and as shown in FIG. 3, suction slots 30 are provided in the wall 24 to extract some of the fluid from the passages 32 defined by adjacent blades 10, 12, etc. The slots 30 are formed by making substantially rectilinear cut-outs 34 in one edge of each of the platforms 22 where they abut an adjacent platform. Beneath the wall 24, and formed by the body 26, platforms 22, and the fir-tree, attachment ends 36 of the blades, are ducts 38. The ducts 38 open onto the slots 30 to evacuate the extracted gas downstream of the blade row; here the effective static pressure of the fluid is low and, consequently, a suction pressure is visited upon the slots 30.

Significant tests of the invention were performed in a wind tunnel; these proved out the effectiveness of the invention in bleeding off secondary flows of gas, and defined the optimum parameters of the invention. It was determined that the best location of the slots is found to be in the vicinity of the suction side of an adjacent blade. Too, the size of the slots 30 was determined to be such that, when the quantity of fluid to be extracted from the passages 32 is near optimum to diminish the secondary flows, they extract approximately one half of one percent of the total flow or capacity of the passages 32. This percentage, however, must be varied depending upon whether the blades are short or long. For example, as we determined in our tests, for a short blade having an aspect ratio (i.e., the ratio of the blade length divided by the blade chord) of one, the slots 30 should be sized to extract approximately one and one half to approximately one and two-thirds percent of the capacity of the passages 32. Conversely, with an aspect ratio of six or more, approximately one-third of one percent to approximately one half of one percent of such capacity needs to be bled off.

An optimum arrangement for the slots 30, then, is depicted in FIG. 4. As shown, we have determined that the slots 30, vis-a-vis the blade chord length should commence about twenty percent of the chord length away from the upstream end of the passages 32, and terminate at a location which is approximately forty-five percent of the chord length from the downstream end of the passages 32. Too, the slots 30 should have a width of approximately not more than five percent of the chord length. Ideally, the ducts 38 should have a cross-sectional area which is approximately thirty percent of the flow area of the slots 30.

The curve shown in FIG. 5 shows the results of our wind tunnel tests. The curve is an extrapolation of all the tests; the latter demonstrated that the secondary erosion of blades was decreased by a factor of three.

While we have described our invention in connection with a specific embodiment thereof it is to be clearly understood that this is done only by way of example, and not as a limitation to the scope of our invention as set forth in the objects thereof and in the appended claims.

We claim:

1. A fluid-handling, bladed rotor, comprising:

a rotor body;

said body having a plurality of juxtaposed recesses formed therein;

an annular wall circumscribing said body;

elongate blades;

each of said blades having (a) a first, radially-extending end projecting outwardly from said wall, and (b) an opposite, attachment end set in one of said recesses; wherein adjacent ones of said blades define fluid flow passages therebetween which accommodate a given fluid flow capacity therewithin; and means in said wall for extracting fluid from said passages; wherein said means comprises means for extracting between approximately one-third of one percent to approximately one and two/thirds percent of said capacity of said passages.

2. A fluid-handling, bladed rotor, according to claim 1, wherein:

said fluid-extracting means comprises voids formed in said wall between adjacent ones of said blades.

3. A fluid-handling, bladed rotor, according to claim 1, wherein:

said rotor has a rotary axis; and said fluid-extracting means comprises slots formed through said wall, between adjacent ones of said blades, which are parallel with said axis.

4. A fluid-handling, bladed rotor, according to claim 3, wherein:

said blades have platforms, intermediate said first and opposite ends thereof, transverse to the lengths of said blades;

said platforms of said blades are in common, abutting relationship about said rotor and define the aforesaid wall; and one edge of each of said platforms has a substantially rectilinear cut-out formed therein, and abuts an edge of a thereadjacent other platform, to define the aforesaid slots in said wall.

5. A fluid-handling, bladed rotor, according to claim 3, wherein:

said blades are of a generally airfoil cross-section, and have a given chord length; and said slots have a length which is not more than approximately thirty-five percent of said chord length.

6. A fluid-handling, bladed rotor, according to claim 3, wherein:

said blades are of a generally airfoil cross-section, and have a given chord length; and said slots have a width which is not more than approximately five percent of said chord length.

7. A fluid-handling, bladed rotor, according to claim 3, wherein:

said blades have a given, overall length;

said passages have upstream and downstream ends; and said slots commence at a point in said wall which is approximately twenty percent of said length from said upstream end, and terminate at a location which is approximately forty-five percent of said length from said downstream end.

8. A fluid-handling, bladed rotor, according to claim 4, wherein:

said body, attachment ends of said blades, and said platforms cooperatively define ducts; and said slots open onto said ducts.

9. A fluid-handling, bladed rotor, according to claim 3, further including:

means for evacuating fluid from said slots.

10. A fluid-handling, bladed rotor, according to claim 9, wherein:

said fluid-evacuating means comprises ducts, opening onto said slots, cooperatively formed by said body, said platforms, and said attachment ends of said blades.

* * * * *